US007356125B2

(12) United States Patent
Vogtmeier et al.

(10) Patent No.: US 7,356,125 B2
(45) Date of Patent: Apr. 8, 2008

(54) ARRANGEMENT FOR COLLIMATING ELECTROMAGNETIC RADIATION

(75) Inventors: Gereon Vogtmeier, Aachen (DE); Wolfgang Eckenbach, Aachen (DE); Ralf Dorscheid, Kerkrade (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/571,711

(22) PCT Filed: Sep. 3, 2004

(86) PCT No.: PCT/IB2004/051683

§ 371 (c)(1),
(2), (4) Date: Mar. 10, 2006

(87) PCT Pub. No.: WO2005/027143

PCT Pub. Date: Mar. 24, 2005

(65) Prior Publication Data

US 2007/0025519 A1 Feb. 1, 2007

(30) Foreign Application Priority Data

Sep. 12, 2003 (EP) ..... 03103365

(51) Int. Cl.
*G21K 1/02* (2006.01)

(52) U.S. Cl. ..... 378/149; 378/210; 250/363.1

(58) Field of Classification Search ..... 378/7, 378/19, 147–155, 185, 186; 250/363.1, 363.08
See application file for complete search history.

(56) References Cited

U.S. PATENT DOCUMENTS 3,988,589 A * 10/1976 Leask ..... 378/149
4,054,800 A * 10/1977 Leask ..... 378/149
4,127,398 A 11/1978 Singer ..... 65/4
4,250,392 A * 2/1981 Leask et al. ..... 250/505.1
4,597,096 A * 6/1986 Larsson ..... 378/149
4,672,648 A * 6/1987 Mattson et al. ..... 378/4
4,706,269 A * 11/1987 Reina et al. ..... 378/154
4,866,744 A * 9/1989 Yoshida ..... 378/7
5,099,134 A * 3/1992 Hase et al. ..... 250/505.1
5,309,911 A 5/1994 Greiner ..... 128/653.1
5,418,833 A * 5/1995 Logan ..... 378/154
6,047,044 A 4/2000 Lehmann et al. ..... 378/154
6,075,840 A 6/2000 Pellegrino et al. ..... 378/154
6,175,615 B1 * 1/2001 Guru et al. ..... 378/149
6,181,767 B1 * 1/2001 Harootian ..... 378/19
6,678,352 B1 * 1/2004 Kumakhov ..... 378/154
6,693,291 B2 * 2/2004 Nelson et al. ..... 250/505.1
2001/0050973 A1 * 12/2001 Ogawa ..... 378/154
2002/0176537 A1 11/2002 Feldmesser et al. ..... 378/154
2003/0076929 A1 * 4/2003 Hoheisel et al. ..... 378/98.8

(Continued)

FOREIGN PATENT DOCUMENTS

EP 0 506 023 A1 9/1992

(Continued)

*Primary Examiner*—Edward J. Glick
*Assistant Examiner*—Anastasia S. Midkiff

(57) ABSTRACT

The invention relates to an arrangement for collimating electromagnetic radiation, comprising a macrocollimator which has at least two cutouts, and microcollimator structures which are positioned in the cutouts of the macrocollimator and have lamellae that absorb electromagnetic radiation, so that collimator channels are formed which in each case extend such that they are transparent in a transmission direction.

15 Claims, 5 Drawing Sheets

U.S. PATENT DOCUMENTS

2003/0235273 A1* 12/2003 Spahn ..... 378/154
2005/0123099 A1* 6/2005 Schneider et al. ..... 378/154

FOREIGN PATENT DOCUMENTS

EP 1 045 398 A2 10/2000
GB 2 148 680 A 5/1985
WO WO 01/43144 A1 6/2001
WO WO 02/065480 A1 8/2002

* cited by examiner

ARRANGEMENT FOR COLLIMATING ELECTROMAGNETIC RADIATION

The invention relates to an arrangement for collimating electromagnetic radiation, in particular X-ray radiation. The invention also relates to an X-ray detector and an X-ray device which are equipped with such an arrangement. Furthermore, the invention relates to a method of producing an arrangement for collimating electromagnetic radiation.

An arrangement for collimating X-ray radiation is known from patent U.S. Pat. No. 3,988,589. This arrangement consists of a number of individual elements which in each case consist essentially of a baseplate. The plate sides have on one side grooves arranged at regular intervals and on the other side ridges (lamellae) arranged at regular intervals. The individual elements may be placed inside one another such that the ridges of one baseplate engage in the grooves of a next baseplate, wherein channels are formed by the baseplates and the lamellae, said channels extending in a transmission direction. Such a collimator block formed from a number of individual elements is placed in a frame in a last production step, wherein the frame has a cutout which extends in the transmission direction and wherein the cutout is greater than the collimator block. The free interspaces between frame and collimator block which extend in the transmission direction are then filled with a radiation-proof material (lead). Overall, a collimator with collimator channels for X-ray radiation which can be used in an Anger camera is thus provided.

It is an object of the invention to provide an arrangement for collimating electromagnetic radiation which is suitable for large radiation detectors.

This object is achieved by an arrangement for collimating electromagnetic radiation, comprising a macrocollimator which has at least two cutouts, and microcollimator structures which are positioned in the cutouts of the macrocollimator and have lamellae that absorb electromagnetic radiation, so that collimator channels are formed which in each case extend such that they are transparent in a transmission direction.

Modern X-ray devices have increasingly large detectors. The dimensions of a radiography detector may for instance be up to 50×50 $cm^2$, and those of a detector as used in computer tomography (CT) may be 100×4 $cm^2$. Even much larger detectors of up to around 100×40 $cm^2$ are conceivable, particularly in the case of CT.

When examining relatively large objects by means of X-ray radiation, so-called scattered radiation is produced. Scattered radiation is produced when X-ray quanta undergo an interaction with the object which interaction does not lead to absorption. Such interaction processes are for example Compton scattering and Rayleigh scattering. In the case of examinations by means of X-ray, however, often only the unscattered X-ray quanta are to be measured on the detector. Scattered X-ray quanta generate a background signal which reduces the contrast and contribute to noise. In the case of large objects and large detectors, the proportion of scattered X-ray quanta may easily be 90% or more.

In other types of examination, the object itself is a source of radiation, for instance in the case of single photon emission computed tomography (SPECT) or positron emission tomography (PET) or in the case of dedicated measurements of scattered X-ray quanta. Each part of the detector then receives X-ray quanta from each part of the object. However, meaningful measurements can often only be carried out when a certain detector part only receives radiation from an area of the object determined by a collimation device.

In both problems, use is made of collimators which are arranged between the detector and the object and serve to suppress certain parts of the X-ray radiation. Collimators have collimator channels which extend in a linear manner. A collimator channel consists of a radiation-transparent inner channel, or an inner channel that only absorbs radiation to a slight extent, and radiation-opaque collimator channel walls, or collimator channel walls which absorb radiation to a greater extent. Each collimator channel is distinguished by extending in a transmission direction. The collimator channel walls border the inner channel essentially parallel to the transmission direction. The transmission direction may be the same for all collimator channels, for instance as in the case of a SPECT collimator in which all the collimator channels are aligned parallel to one another, or else the transmission direction may change from collimator channel to collimator channel, for instance as in the case of a CT collimator, the individual collimator channels of which are aligned on the focus point of an X-ray source. Radiation which enters a collimator channel and differs in terms of its propagation direction from the transmission direction of the collimator channel is highly likely to be absorbed in the radiation-opaque collimator channel walls. In local terms, a collimator therefore essentially allows through only radiation having a propagation direction which corresponds to the transmission direction.

Collimators for collimating X-ray radiation are typically made from a material which greatly absorbs the X-ray radiation used, for instance from a heavy metal such as lead. Other metals may also be used, such as tungsten, tantalum, molybdenum or alloys such as bronze with a high tin content or compounds with a heavy metal such as tungsten oxide or tungsten carbide, or else use may be made of hybrid materials which consist for instance of a plastic matrix comprising embedded metal powders. In the case of low-energy X-ray radiation (as used for example in mammography), it is also possible to use copper, titanium or iron or materials with similar X-ray absorption.

In the case of CT or modern PET detectors, it is furthermore important that the individual grid channels are geometrically assigned precisely to one detector element. The geometric precision of a large collimator with a large number of collimator channels can be maintained only with difficulty and at a high cost. Cast or injection-molded components which are cost-effective to produce have known precision problems at relatively large dimensions, and these problems are manifested for instance by shrinkage upon cooling and deformation with uneven cooling. Precise components which can be produced for instance by wire EDM or etching processes are extremely time-consuming and costly.

The collimator arrangement according to the invention has a macrocollimator which defines the overall geometry. Since the macrocollimator has cutouts for microcollimators, the macrocollimator requires only a small number of inner structures. The macrocollimator may then be produced with high precision (for instance by wire EDM or by stacking etched metal sheets on top of one another) without entailing high costs. The fine structure of the collimator is produced by the microcollimator structures. These may then be produced in inexpensive methods (for instance by means of a casting process—e.g. lead casting or plastic injection molding, with it being possible for metal powder to be embedded in the plastic—or by simply placing sheets of metal inside one another in order to form a microcollimator with parallel collimator channels). The precision of the microcollimators must be sufficient only for part of the overall collimator surface.

One embodiment of a collimator arrangement according to the invention has microcollimator structures which have collimator channels that at the side (that is to say perpendicular to the transmission direction) are not completely enclosed by lamellae. The complete enclosure to form a collimator channel is achieved by the walls of the macrocollimator when the microcollimator structure is positioned in the macrocollimator. In this way it is possible to make the macrocollimator walls as thick as the lamellae thickness without the entire wall thickness between two inner channels separated by a macrocollimator wall becoming greater than the wall thickness between two inner channels separated by a lamella of a microcollimator structure.

In a further embodiment of a collimator arrangement according to the invention, there is at least one guide structure. A guide structure aids the precise positioning of a microcollimator structure relative to the macrocollimator. A guide structure may be for example a groove or a guide rail.

In another embodiment of a collimator arrangement according to the invention, there is at least one positioning structure. A positioning structure is used for the precise positioning of the collimator arrangement relative to an external unit, for instance a pixelated detector. It is then possible to assign the collimator channels particularly precisely to the individual detector pixels, for example such that the collimator channel walls are in each case positioned between two detector pixels and therefore a shading of the radiation on the individual detector pixels by the collimator channel walls is avoided.

In one embodiment of a collimator arrangement according to the invention, the cutouts are aligned in a focusing manner. In this way, microcollimator structures that collimate in a parallel manner and are cost-effective to produce can be positioned in the individual cutouts and nevertheless an overall focusing of the collimator arrangement is achieved. Since collimator channels which are locally aligned in parallel lead to radiation shading in the case of focusing collimation that is to be achieved overall, the geometry of the cutouts and of the microcollimators must be selected such that an acceptable level of shading is not exceeded.

A collimator arrangement according to the invention can be advantageously used in an X-ray detector unit. In one embodiment of such an X-ray detector unit, elements of the X-ray detector unit are connected integrally with the microcollimator structures. In this way, an X-ray converter (e.g. a scintillator) may for instance in each case be accommodated in a collimator channel.

The invention also relates to an E-ray device in which a collimator arrangement according to the invention is used. This may be arranged in the X-ray device for example in a manner such that it can be replaced or as part of the X-ray detector unit.

The invention furthermore relates to a method of producing a collimator arrangement, wherein in one embodiment micro collimator structures are produced by a casting or injection-molding process (for example a lead casting process or a plastic injection-molding process).

The invention will be further described with reference to examples of embodiments shown in the drawings to which, however, the invention is not restricted FIG. 1 shows a schematic diagram of a collimator arrangement according to the invention with macrocollimator and one microcollimator structure shown by way of example.

Figure 1:
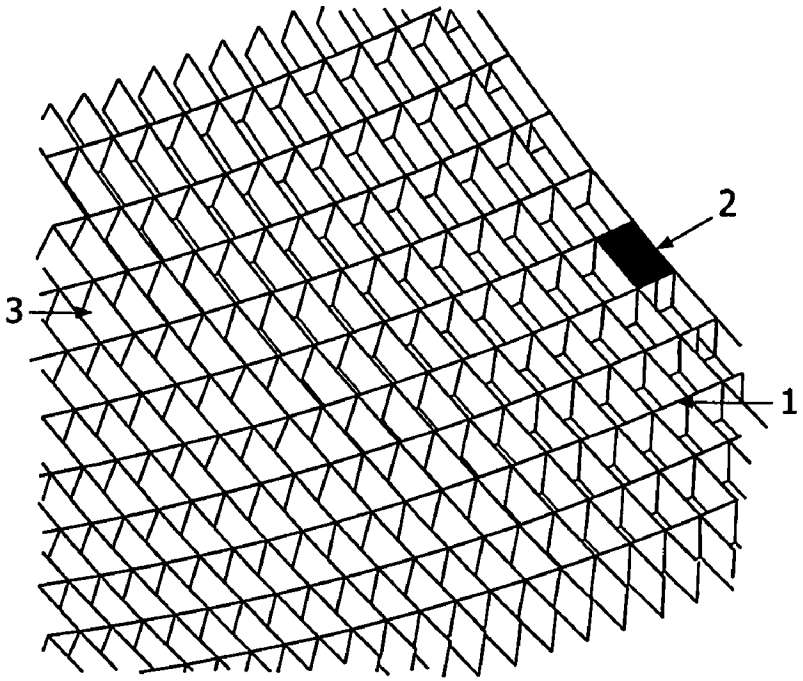

FIG. 1 shows a schematic diagram of a macrocollimator 1 in which one microcollimator structure 2 is positioned by way of example in one of the cutouts 3.

Figure 2:
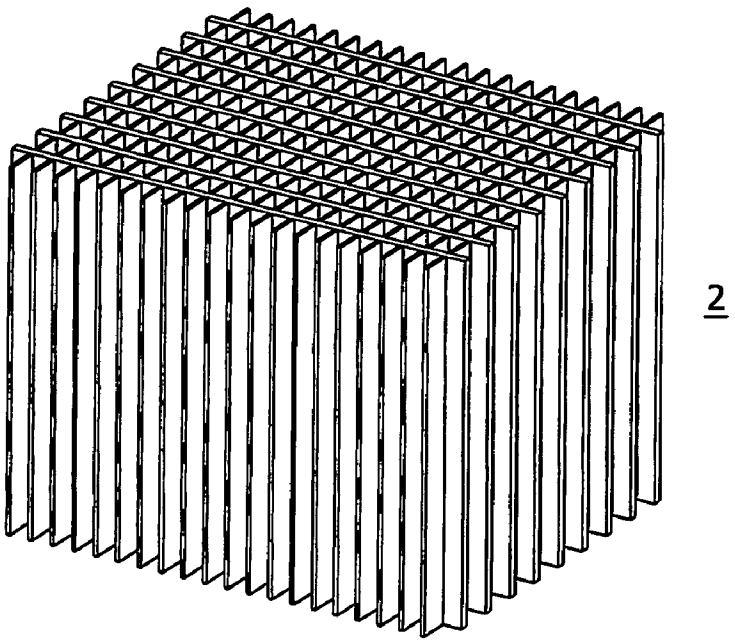
FIG. 2 shows an individual diagram of a microcollimator structure.

FIG. 2 shows one embodiment of a microcollimator structure 2. Such a microcollimator structure may be produced for instance in a casting or injection-molding method. Lead casting and plastic injection-molding may be mentioned here as examples. In a collimator for X-ray radiation, it is advantageous if in the plastic injection-molding method for example X-ray-absorbing powders (e.g. tungsten powder with particle sizes in the micrometer range) are incorporated in the plastic. Another method of producing a microcollimator structure is placing sheets that absorb electromagnetic radiation inside one another. This can easily be done in the case of collimator channels which are aligned in parallel. The microcollimator structure shown in FIG. 2 has transparent collimator channels which in each case extend in the transmission direction. In this context, transparent is to be understood as meaning that, for example, even fixings with low radiation absorption (e.g. a fixing plate made of plastic which fixes the positioned microcollimator structures in the macrocollimator) do not alter the transparency. In the embodiment shown, the radiation-transparent inner channels are formed by air and the collimator channel walls are formed by lamellae, the extension direction of which is essentially the same as the transmission direction of the respective collimator channels.

The embodiment of a collimator arrangement according to the invention shown in FIG. 1 shows that, given a suitably precise production of the macrocollimator, very large collimator arrangements can be produced with high overall precision and low costs. The costs for the precise macrocollimator are low since the cutouts 3 may be selected to be large compared to the desired collimator channels and therefore only a small number of precise structures of the macrocollimator have to be produced.

Figure 3:
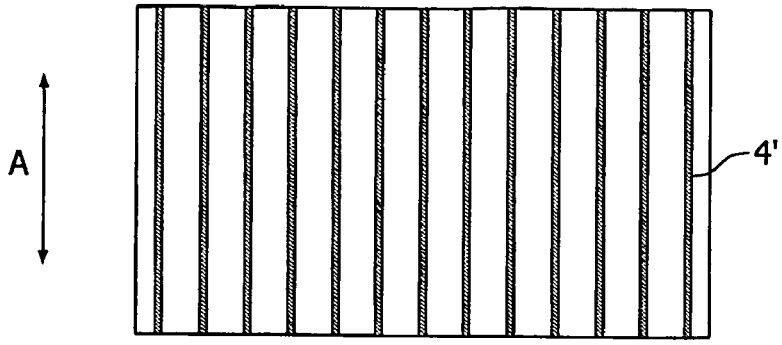
FIG. 3 shows a side view of a microcollimator structure with collimator channels aligned in parallel.

FIG. 3 shows a side view of a microcollimator structure 2 with collimator channels which are aligned in parallel (this is also referred to as a parallel collimator). The transmission direction runs in the direction of the double arrow A. Parallel collimator arrangements are used for example to obtain a parallel projection image of an extended source distribution, for instance in the case of SPECT. The hatched lamellae 4' are in this embodiment to be understood as running perpendicular to the plane of the paper. Lamellae 4" (cf. FIG. 4) are arranged at regular intervals parallel to the plane of the paper, said lamellae together with the lamellae running perpendicular to the plane of the paper bordering inner channels of collimator channels.

Figure 4:
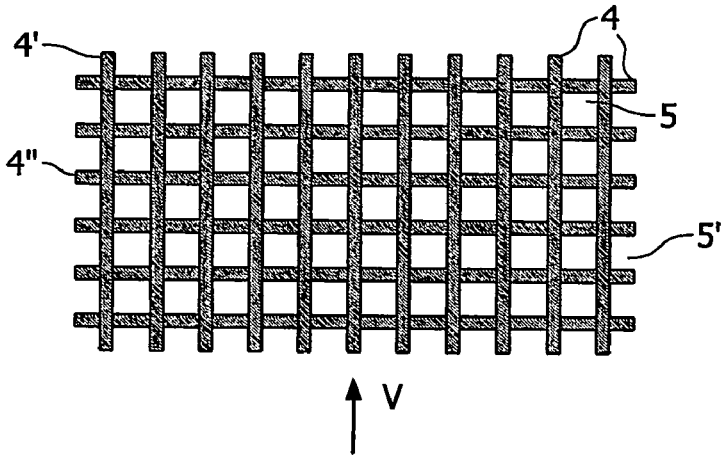
FIG. 4 shows an aspect of the microcollimator structure of FIG. 3.

FIG. 4 shows an aspect of the microcollimator structure of FIG. 3. The lamellae 4 enclose collimator channels 5 which are transparent in the transmission direction, such that the collimator channels 5 have a rectangular cross section. In the embodiment shown (which corresponds to the side view in FIG. 3, with the side view being understood to be in the direction of the arrow V), there are lamellae 4' and lamellae 4" which run perpendicular to one another and as a result form the rectangular cross section of the collimator channels 5. In the embodiment shown, at the sides of the microcollimator structure which extend in the transmission direction there are formed collimator channels 5' which are open at the side on account of not being completely enclosed by lamellae. There may also be embodiments of a microcollimator structure of the type shown which do not have any collimator channels 5' that are open at the side or which have collimator channels 5' that are open at the side on only one or two or three sides.

Figure 5:
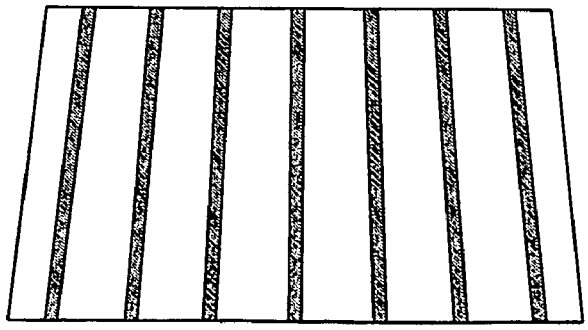
FIG. 5 shows a side view of a microcollimator structure with collimator channels aligned in a focusing manner.

FIG. 5 shows a side view of a microcollimator structure with collimator channels which are aligned on a point (this is also referred to as a focusing collimator). The hatched lamellae which run perpendicular to the plane of the paper are aligned on a point. Such an embodiment of a microcollimator structure is advantageous for example when the radiation from a point source, e.g. an X-ray source, is to be allowed through and radiation from other sources, for instance scattered radiation from an irradiated object, is to be absorbed in the lamellae. The lamellae which run in the plane of the paper either may extend parallel to the plane of the paper, which leads to focusing of the overall microcollimator structure on a line, or are likewise aligned on the source point, which means that the lamellae are in each case arranged perpendicular to the plane of the paper at such an angle that all the collimator channels 5, 5' produced are aligned on a source point. The transmission direction for each collimator channel then points in each case to this focus point.

Instead of the embodiments with rectangular collimator channels shown here, collimator channels of different geometric shape may also be enclosed by the lamellae, for instance collimator channels of hexagonal or round cross section. The shape of the cross section of different collimator channels may also be different.

Figure 6:
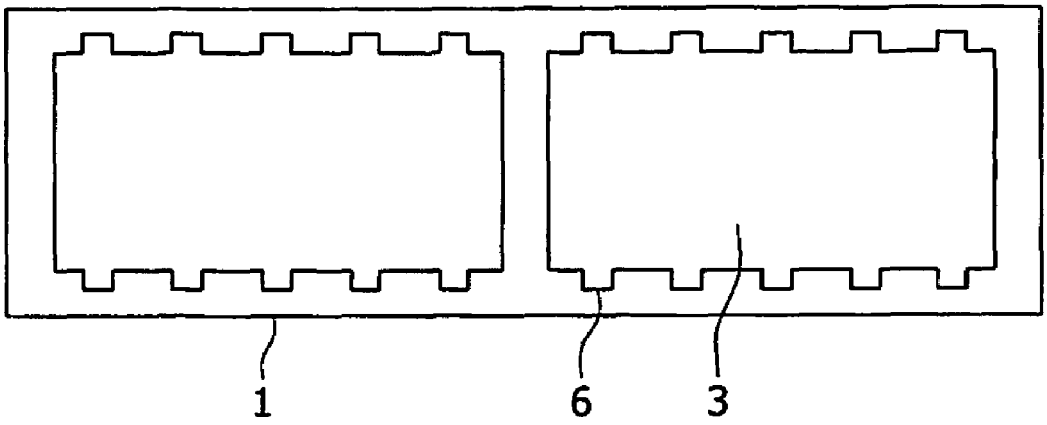
FIG. 6 shows an aspect of a macrocollimator with guide structures.
Figure 7:
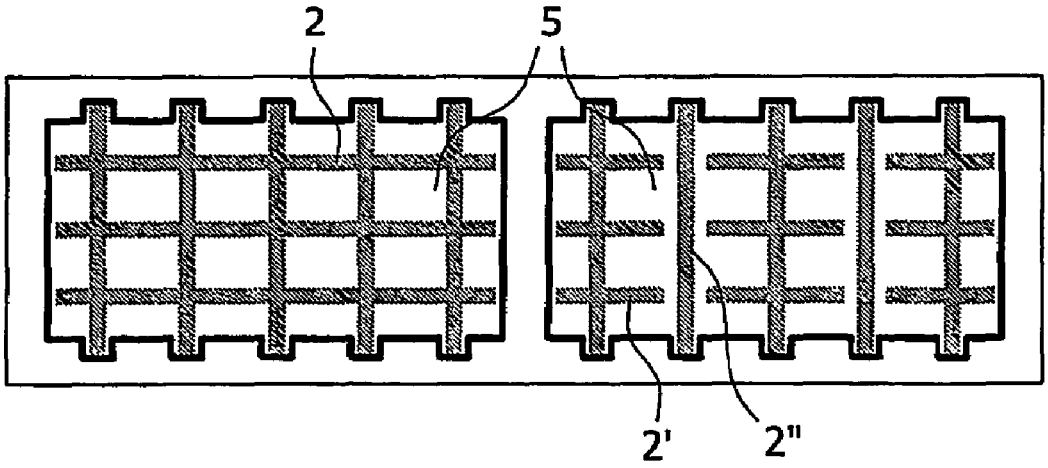
FIG. 7 shows an aspect of a macrocollimator, in the left cutout of which there is positioned one microcollimator structure and in the right cutout of which there are positioned a number of microcollimator structures.

FIG. 6 shows an aspect of a macrocollimator I with two cutouts 3, wherein notches 6 are made at some points in the walls of the macrocollimator. FIG. 7 shows the collimator arrangement with microcollimator structures 2, 2', 2" positioned in the cutouts. One microcollimator structure is positioned in the left-hand cutout, as is known from FIGS. 3 to 5. The left-hand cutout is filled by a single microcollimator structure. The notches 6 are used as guide structures which position the microcollimator structure relative to the macrocollimator. A precise positioning of the microcollimator structures is facilitated by guide structures. Instead of notches, the guide structures may also be formed by other structures known to the person skilled in the art, such as dents, or by guide rails which are additionally attached. Furthermore, the walls of the macrocollimator in this embodiment enclose the open collimator channels of the microgrid structure, so that completely enclosed collimator channels are formed. By means of open collimator channels, the situation is avoided whereby the outer wall thickness of the microcollimator and the wall thickness of the macrocollimator are added together. For a uniform size and a uniform spacing of all collimator channels of the collimator arrangement, the outer walls of the micro collimator structures would then have to be made very thin compared to the thickness of the lamellae.

A microcollimator structure according to the invention may also have collimator channels which are filled with a material that is only slightly absorbent, such as a polyurethane foam. This is advantageous in order to increase the stability of the microcollimator structure. In one embodiment, there are microcollimator structures which are produced from a block of a slightly absorbent material (for instance a hard foam) which has incisions into which absorbent lamellae are placed. In this way, lamellae which are unstable per se (for example thin lead lamellae) may also be used, since the hard foam defines the stability. Even in the case of filling with a slightly absorbent material, the collimator channels are to be regarded as transparent since the X-ray radiation is attenuated only a little within the slightly absorbent material compared to the absorbent lamellae.

Various microcollimator structures are positioned in the right-hand cutout of the macrocollimator in FIG. 7. In this embodiment which is shown by way of example, there are alternately comb sheets 2' and flat sheets 2" which in their entirety fill the cutout such that collimator channels are formed in this case too. In this embodiment, there are microcollimator structures 2" which have neither closed nor open collimator channels. Closed collimator channels 5 are formed only in collaboration with other microcollimator structures 2' and the walls of the macrocollimator 1. Instead of comb sheets and flat sheets, sheets of different form may also be used as microcollimator structures if said sheets can be placed in the cutouts such that collimator channels are formed. Such sheets may be for example deep-drawn sheets.

Figure 8:
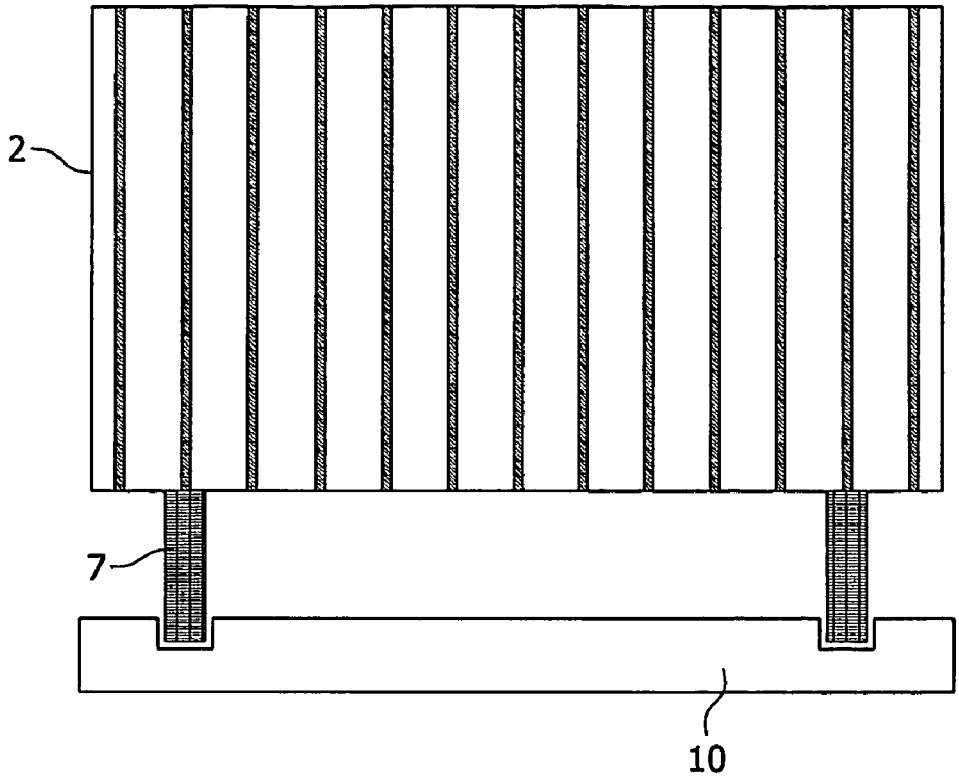
FIG. 8 shows a side view of a microcollimator structure with positioning structures which allow positioning with respect to an external unit.

FIG. 8 shows a side view of a microcollimator structure 2 on which positioning structures 7 are fitted. The positioning structures 7 may in this case have been formed integrally during the production process or be attached subsequently. The positioning structures 7 allow the positioning of the microcollimator structure 2 relative to an external element 10. In the embodiment shown, the positioning structures 7 engage in recessed parts of the external element 10. A precise alignment of the collimator channels with respect to structures of the external element 10 (for instance photodiodes for measuring electromagnetic radiation) can thus be achieved.

Figure 9:
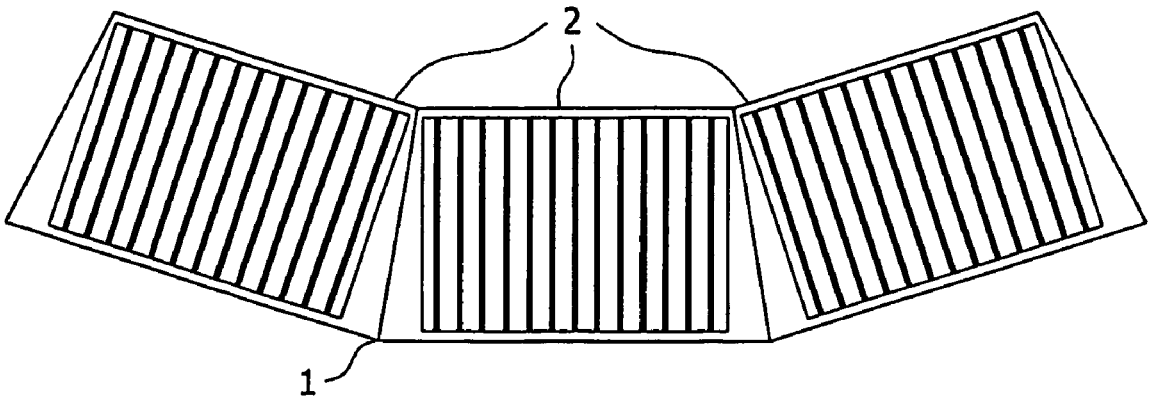
FIG. 9 shows a side view of a collimator arrangement with a macrocollimator aligned in a focusing manner and with microcollimator structures positioned in the cutouts, said microcollimator structures having collimator channels which are aligned in parallel.

FIG. 9 shows a side view of a collimator arrangement with a macrocollimator 1 and microcollimator structures 2 positioned in the cutouts of the macrocollimator. In this embodiment, the macrocollimator 1 is designed to be focusing, wherein the cutouts are designed such that their respective collimation directions are aligned on one point. If the microcollimator structures, as in the example shown, are designed to collimate in parallel, then the collimator arrangement nonetheless still has a focusing alignment overall on account of the macrocollimator. Depending on the height of the microcollimator structure, the cross-sectional area of the collimator channels and possibly other geometric parameters, the size of the cutouts may be selected such that a focusing collimation of the overall collimator arrangement that is acceptable for the respective application is nevertheless produced. The use of parallel microcollimator structures offers the advantage that the latter can be produced more easily than focusing microcollimator structures.

Figure 10:
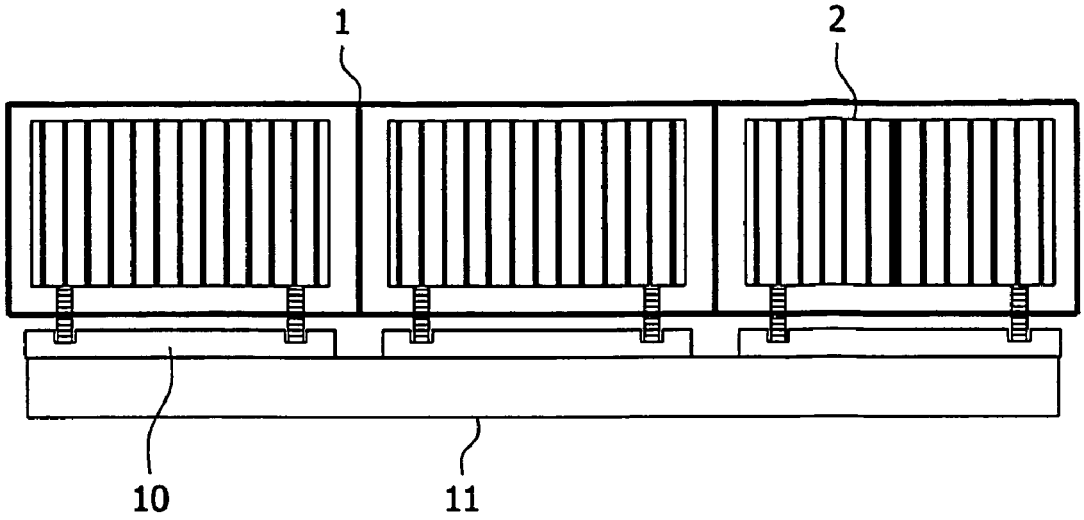
FIG. 10 shows a side view of an X-ray detector comprising a collimator arrangement according to the invention.

FIG. 10 schematically shows an X-ray detector in side view, in which a collimator arrangement according to the invention is used. Scintillator photodiode matrix modules 10 are arranged on a substrate 11. X-ray radiation which impinges on a scintillator and interacts with the latter is converted into optical light which the photodiodes measure and convert into an electrical signal. The collimator arrangement is arranged between the detector and the radiation source.

Figure 11:
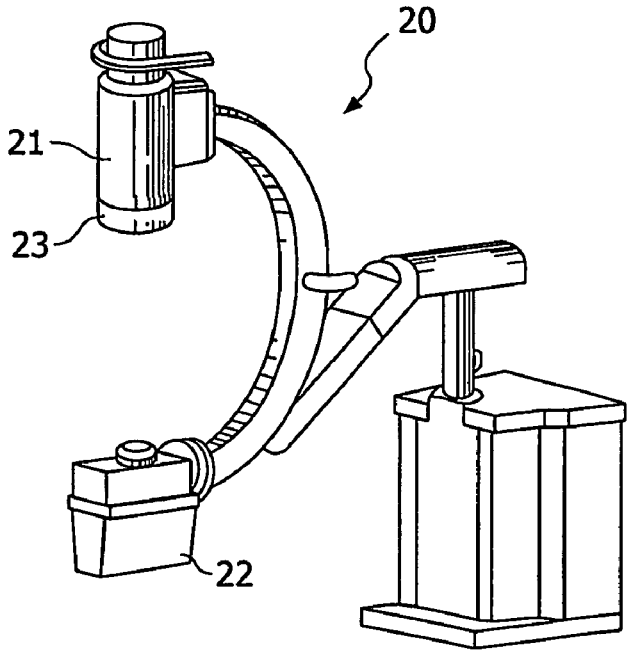
FIG. 11 shows an X-ray imaging device which is equipped with a collimator arrangement according to the invention.

FIG. 11 shows by way of example a medical X-ray imaging device 20 with an X-ray source 22 and an X-ray detector 21, in which a collimator arrangement 23 according to the invention is used, said collimator arrangement in this embodiment being arranged on the X-ray detector 21 between the X-ray source 22 and the X-ray detector 21. The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. An arrangement for collimating electromagnetic radiation, comprising:

a macrocollimator which defines at least two cutouts, the macrocollimator defining a plurality of parallel notches on opposite faces of each of the cutouts; and microcollimator structures which are positioned in the cutouts of the macrocollimator and have lamellae that absorb electromagnetic radiation, so that collimator channels are formed which in each case extend such that they are transparent in a transmission direction, ends of at least some of the lamellae being received in the macrocollimator notches.

2. An arrangement as claimed in claim 1, wherein the lamellae of the microcollimator structures define a plurality of closed collimator channels and along opposite sides define open collimator channels which perpendicular to the transmission direction are not completely enclosed by lamellae, lamellae of the open collimator channels beign received in the macrocollimator notches and the enclosure is completed by walls of the macrocollimator.

3. An arrangement as claimed in claim 1, wherein the cutouts are arranged in a focusing manner.

4. An X-ray detector unit comprising an arrangement as claimed in claim 1.

5. An X-ray detector unit as claimed in claim 4, wherein at least one of the microcollimator structures is integrally provided with elements of the X-ray detector unit.

6. An X-ray device comprising an arrangement as claimed in claim 1.

7. A method of producing an arrangement for collimating electromagnetic radiation, said method comprising the following steps:

manufacturing a macrocollimator which has at least two cutouts, manufacturing microcollimator structures which have lamellae that absorb electromagnetic radiation, inserting the microcollimator structures in the cutouts so that collimator channels are formed which in each case extend such that they are transparent in a transmission direction.

8. A method as claimed in claim 7, wherein at least one of the microcollimator structures has been produced in a casting or injection molding method.

9. A method as claimed in claim 7 wherein the macrocollimator is manufactured in a process separate from the microcollimators and subsequent to their manufacture the microcollimators are frictionally received within cutouts defined by the macrocollimator.

10. A method as claimed in claim 7 wherein the macrocollimator and microcollimators are manufactured separately.

11. A collimator having precise collimation channels for collimating electromagnetic radiation comprising:

a macrocollimator encircling and defining a plurality of cutouts which are large relative to the collimator channels;

a plurality of microcollimators having lamellae which define the collimator channels, the microcollimators each conforming to a size of the cutouts and being configured to be inserted into and received by one of the cutouts such that the macrocollimator guiding the received microcollimators into an orientation in which the collimator channels extend in an electromagnetic radiation transmission direction.

12. The collimator as claimed in claim 11, wherein the microcollimator defines positioning structures on a surface of each of the cutouts, the positioning structures interacting with the microcollimator structures during insertion to position the microcollimator structures relative to the macrocollimator.

13. The collimator as claimed in claim 12, wherein the positioning structures include guides extending along surfaces of the macrocollimator which define the cutouts.

14. The collimator according to claim 13, wherein the guide structures includes notches or channels which extend parallel to the electromagnetic radiation transmission direction.

15. The collimator as claimed in claim 11, wherein the lamellae are made of an electromagnetic radiation absorbent material, and further including:

a material which is only slightly electromagnetic radiation absorbent relative to the material of the lamellae which fills the collimator channels.

* * * * *